US006578254B2

(12) United States Patent
Adams et al.

(10) Patent No.: US 6,578,254 B2
(45) Date of Patent: Jun. 17, 2003

(54) DAMASCENE FABRICATION OF NONPLANAR MICROCOILS

(75) Inventors: David P. Adams, Albuquerque, NM (US); Michael J. Vasile, Ruston, LA (US)

(73) Assignee: Sandia Corporation, Albuquerque, NM (US)

( * ) Notice: Subject to any disclaimer, the term of this patent is extended or adjusted under 35 U.S.C. 154(b) by 54 days.

(21) Appl. No.: 09/733,396

(22) Filed: Dec. 8, 2000

(65) Prior Publication Data

US 2002/0069512 A1 Jun. 13, 2002

(51) Int. Cl.[7] ..... H01F 7/06

(52) U.S. Cl. ..... 29/606; 29/874; 29/876; 29/605; 29/884; 29/456; 29/439; 216/8; 216/18; 216/88; 427/534

(58) Field of Search ..... 29/605, 606, 894, 29/876, 884, 439, 456; 216/8, 18, 39, 52, 66, 88, 105; 336/200, 223, 232, 83; 427/290, 532, 534, 117, 286, 287, 533; 204/192.34

(56) References Cited

U.S. PATENT DOCUMENTS 3,665,597 A * 5/1972 Tan ..... 29/605
4,361,597 A * 11/1982 Arima ..... 427/53.1
4,882,833 A * 11/1989 Hiramatsu ..... 29/596
5,039,964 A * 8/1991 Ikeda ..... 333/181
5,649,353 A * 7/1997 Salasoo ..... 29/605
5,779,969 A * 7/1998 Chatterjee ..... 264/619
6,114,937 A 9/2000 Burghartz et al. ..... 336/200
6,158,109 A * 12/2000 Tanabe ..... 29/605
6,225,223 B1 * 5/2001 Liu ..... 438/687

OTHER PUBLICATIONS

D. P. Adams, G. L. Benavides, M. J. Vasile; Micrometer–Scale Machining of Metals and polymers Enabled by Focused Ion Beam Sputtering; Nov. 1988; 15 pgs.

P. C. Andricacos, C. Uzoh, Jo. O. Kukoic. U. Horkans and H. Deligianni; Damascene copper electroplating for chip interconnections; Jun. 30, 1998; pp 1–7.

* cited by examiner

*Primary Examiner*—Peter Vo
*Assistant Examiner*—Alan M Boswell
(74) *Attorney, Agent, or Firm*—George H. Libman; Fred A. Lewis

(57) ABSTRACT

A process for fabricating coils using a Damascene process uses a curved substrate having a surface extending along and about an axis made of a first material. A groove is formed in the curved surface along and around said axis, and the groove is filled with a second material that is different from the first material to form a coil of second material in said first material. Excess second material is then removed from the surface of the first material, leaving the coil of second material in the groove.

15 Claims, 2 Drawing Sheets

24
10
20

30
-10-
20

-40-
-10-
30
20

50
52

-52-

54
51
56

54
51
56

DAMASCENE FABRICATION OF NONPLANAR MICROCOILS

CROSS REFERENCE TO RELATED APPLICATIONS (Not Applicable)

The United States Government has rights in this invention pursuant to Department of Energy Contract No. DE-AC04-94AL85000 with Sandia Corporation.

BACKGROUND OF THE INVENTION

Many techniques are known and used for manufacture of coils for mechanical, electrical, and electromagnetic applications. For example, an elongated flexible structure such as a thread or wire may be helically wrapped around a cylindrical surface to define the coil. Alternatively, an electrical conductor may be deposited in a helical path around a surface. However, when the desired coil is is for a microsystem and has many turns having a diameter on the order of a few millimeters, and a conductor diameter on the order of tens of micrometers, conventional fabrication techniques are not sufficient.

Alternative techniques are therefore being explored to meet the manufacturing requirements of microsystems. While a large variety of microcomponents and microelectromechanical devices have been demonstrated in recent years, most fabrication has involved inherently planar techniques, such as x-ray or optical lithography. Features are defined in polished substrates or thin film layers by exposure of a resist (using a mask) and etching. However, there is a desire to fabricate more complex shaped features in a variety of ceramics, metals and polymers. For example, nonprismatic features and nonplanar workpieces are needed for a variety of devices such as micro-fluidic sensors, microinductors, and microactuators.

Recently, several groups have demonstrated techniques that fabricate curvilinear features. This includes microcontact printing which applies a 'two dimensional' lithographic master to a substrate such as a cylinder (see R. J. Jackman et al, "Design and Fabrication of Topologically Complex, Three-dimensional Microstructures," *Science,* 1998, 280, 2089–2091), and laser chemical vapor deposition which involves direct writing of materials via pyrolysis or photodecomposition of precursor gases. (See J. Maxwell et al., "Rapid Prototyping of Functional Three-Dimensional Microsolenoids and Electromagnets by High-Pressure Laser Chemical Vapor Deposition," *Proc. Solid Freeform Fabrication Symposium,* 1998; 529–536.) Other inherently planar techniques such as LIGA are also being adapted to produce overhangs and curved features, as reported by T. R. Christenson, "Advances in LIGA-based post-mold fabrication," *Proc. of SPIE Micromachining and Microfabrication Process Technology IV,* 1998; 3511, 192–203 and others. Nevertheless, additional capabilities are required, since many of the aforementioned techniques are limited in dimensionality, material complexity or microstructure control.

Focused ion beam (FIB) sputtering is attractive for fabricating micron-size tools or instruments that can precisely define curved features (See M. Vasile et al., "Microfabrication techniques using focused ion beams and emergent applications", *Micron* 30 (June 1999) 235–244). Commercial focused ion beam systems are quite powerful, providing 10 nA currents, 10 nm spot sizes, and 10 nm pixel spacings. Most importantly, focused ion beam sputtering can be used to create and align a number of nonplanar features, such as facets required on micro-shaping tools. Several studies demonstrate FIB-sputtered microgears, microwrenches, microscalpels, and nanoindenters. The intent of current work is to fabricate micron size features over centimeter length scales in reasonable time. Further, it is expected that tools having ~25 $\mu$m diameters are mechanically robust and reproducibly define microscopic features. Recent work shows that ground metal micro-end mill tools having cutting diameters of ~50–100 $\mu$m successfully machine small grooves in stainless steel workpieces, as reported by T. Schaller et al., "Microstructure grooves with a width of less that 50 $\mu$m cut with ground hard metal micro end mills", *J. Prec. Eng.* 1999; 23, 229–235.

Additional studies demonstrate that ~25 $\mu$m diameter, FIB-fabricated micro-end mills machine trenches in polymethyl methacrylate (PMMA) and metal workpieces. Material has been mechanically removed from metal alloy workpieces at a rate of $2\times10^4$ $\mu m^3$/sec for over an hour. In comparison, typical ion beam sputter removal rates are ~0.1–20 $\mu m^3$/sec using commercial FIB systems. In the present work, focused ion beam sputtering is combined with ultra-precision machining in order to create complex features in a variety of materials. This includes micromachining approximately 15–100 $\mu$m wide, curvilinear features in planar and cylindrical workpieces.

A method for filling small grooves is the Damascene process, where a groove is made in a substrate, the substrate and groove are coated with a material, and the material is removed from the substrate but remains in the groove. See P. Andricacos et al., "Damascene copper electroplating for chip interconnections", IBM Journal of Research and Development, Vol. 42, No. 5, 1998. While the Damascene process has been utilized for industrial purposes on planar substrates by the semiconductor industry, it has not been employed on curved surfaces other than to provide artistic decoration to objects.

SUMMARY OF THE INVENTION

It is an object of this invention to create very small patterns in non-planar surfaces by machining the features in the surface, filling the machined features with a second material, and treating the surface to remove any excess second material.

It is a further object of this invention to create very small coils on round substrates by machining a helical groove in the substrate, filling the groove with a conductive material, and removing any conductive material that overflows the groove.

To achieve the foregoing and other objects, and in accordance with the purpose of the present invention, as embodied and broadly described herein, the present invention may comprise a process for fabricating coils including providing a curved substrate made of a first material and having a surface extending along and about an axis; forming a helical groove in the curved surface along and around the axis, said groove extending at least one turn around the axis; and filling the groove with a second material different from the first material to form a coil of second material in said first material.

Additional objects, advantages, and novel features of the invention will become apparent to those skilled in the art upon examination of the following description or may be learned by practice of the invention. The objects and advantages of the invention may be realized and attained as particularly pointed out in the appended claims.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

Figures 1A, 1B, 1C, 2A, 2B, 2C, 2D:
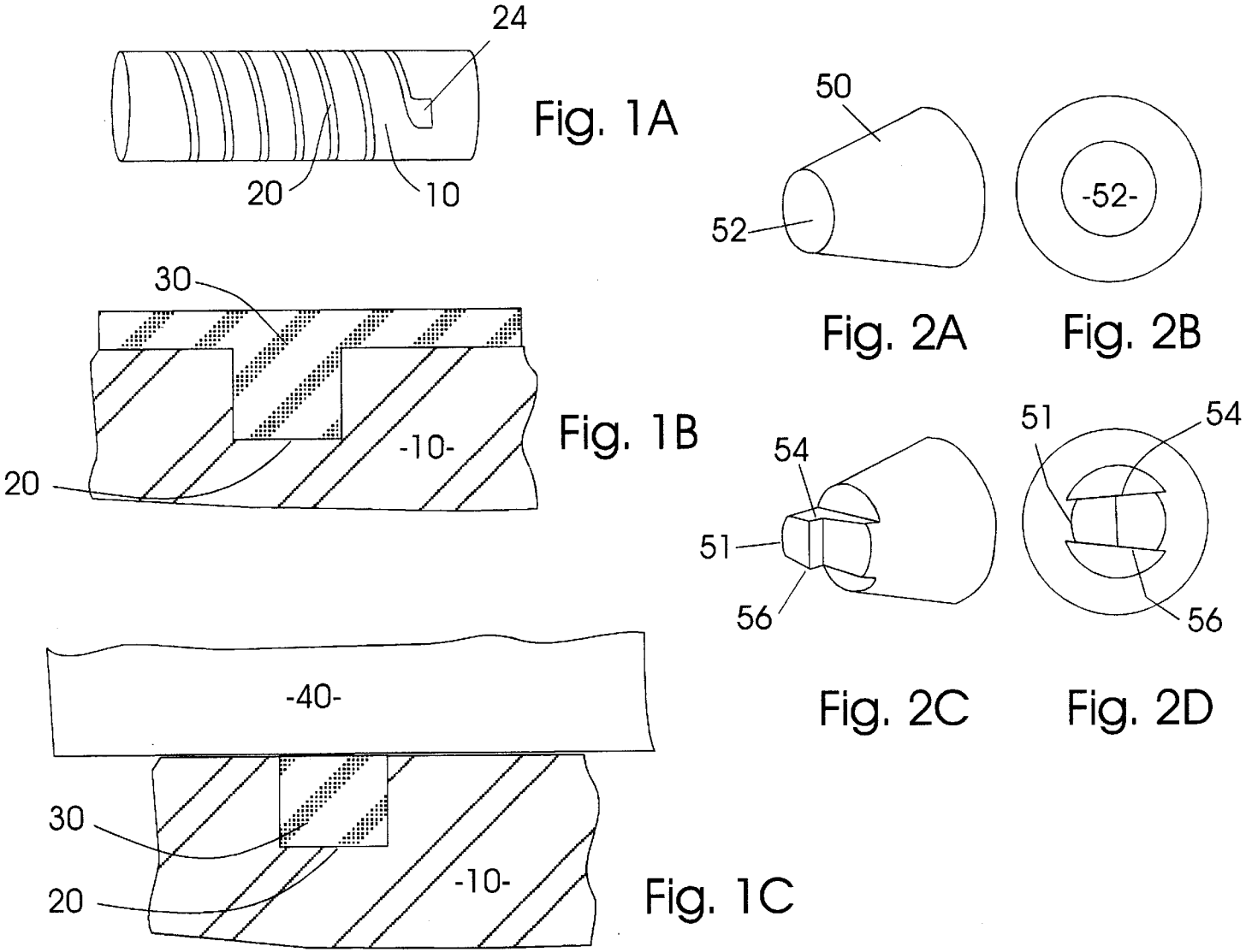
FIGS. 1A–1C show the steps of an embodiment of the invention.
FIGS. 2A and 2B show two views of a blank from which a tool is made for use in the invention.
FIGS. 2C and 2D show two views of a finished tool used in the invention.

The first step of a preferred embodiment of this invention is shown in FIG. 1A to comprise a cylindrical rod 10 having a helical groove 20 formed therein by mechanical or laser cutting, or any other technique. Rod 10 and groove 20 may be of any size, but preferably rod 10 has a diameter on the order of a millimeter and the width and depth of groove 20 is ~0.1 to 10's of micrometers. One end of groove 20 is shown as being enlarged to form a pad 24 to provide for an electrical connection as discussed hereinafter.

FIG. 1B shows a sectional detail from FIG. 1A of a portion of an edge of rod 10 at a groove 20. The second step comprises coating rod 10 and groove 20 with a material 30 that is preferably different from the material or materials which form rod 10. For larger rods, the coating could be applied by spraying, dipping, or similar techniques; for the preferred smaller rod, material 30 may be applied by deposition, electroplating, or equivalent techniques. The important consideration for this step is that all of groove 20 is filled by the coating, and the surface of rod 10 adjacent groove 20 is completely covered by material 30.

FIG. 1C shows the same view as FIG. 1B. In the third step of this invention, material 30 is removed from the surface of rod 10 without removing material 30 from groove 20. This removal may be accomplished by turning rod 10 in a lathe or similar apparatus and either mechanically scraping material 30 with a relatively wide blade 40 down to or just below the surface of rod 10 (as shown in FIG. 1C), abrading the material 30 by polishing, ablating the material 30 with a laser, or similar process. If rod 10 is not easily machined, chemical or anodic dissolution may be required to remove the excess material 30 from the substrate.

The method of this invention may be applied to non-planar substrates of any size and shape; however, it is most applicable to the making of microcoils, typically for electronic or mechanical applications, as these small coils cannot readily be made by other means. This application requires techniques that precisely define curved grooves, such as those utilizing micro-threading tools. As indicated above, the techniques for manufacturing such tools are known in the art; however, since they are not widely practiced, the manufacture of tools utilized in the invention is described below.

Tool blanks may be made of cobalt M42 high-speed steel or C2 micrograin tungsten carbide. For tests of the invention, tool shanks had a diameter of 1.02 mm and were brazed into a centerless ground mandrel either 2.3 mm or 3.175 mm in diameter. One end of each tool was preferably tapered by diamond grinding and polished; this end has a diameter of approximately 25 $\mu$m and is cylindrical over a length of 25 $\mu$m.

Manufacture of Tools

To form the tools, a liquid metal ion gun may be utilized that produces a 20 keV focused ion beam of $Ga^+$ ions with a Gaussian intensity distribution and a full-width at half-maximum diameter of 0.4 $\mu$m on target. Currents are typically 2 nA in a Faraday cup, giving a current density of ~1.5 A/cm$^2$. In practice an operator outlines a desired shape for removal on a secondary electron image of the target, and an octapole deflection system steers the ion beam to designated areas with sub-micron resolution. Between sputter removal steps, a stage positions tools with 1 $\mu$m accuracy. This stage also provides for sample rotation with a minimum step size of 0.37° per pulse, which is a critical element of tool fabrication. The $Ga^+$ source chamber is ion pumped and maintains a pressure of $10^{-9}$ Torr. The target chamber has an oil diffusion pump and pressures of $10^{-8}$ Torr during sputtering. A small aperture separates the two chambers for differential pumping.

Micro-grooving and micro-threading tools have designs similar to conventional lathe cutting tools, however, cutting edge dimensions are in the ~10–30 micron range. Each microtool is fabricated from a polished blank to have sharp cutting edges, clearance behind cutting edges and rake features. This shape is achieved by sputtering a number of strategically placed facets on cylindrical or conical sections at the end of a tool blank. In general, the tool rotation/sputter sequence and the location of facets are critical for defining tool characteristics (rake, etc.). An example of this procedure is shown in FIG. 2.

The first step of fabricating all micro-grooving and micro-threading tools involves shortening a polished blank 50. A smooth facet 52 is sputtered at the tool end as shown in FIGS. 2A and 2B. After sputtering, the end facet is nearly perpendicular to the tool axis Next, material is removed to create two facets 54, 56 on opposite sides of the tool 50. This sputter step determines the cutting width, tool cross-section and, hence, the intended cross-sectional shape of a micromachined groove. For example, ion milling two nearly-parallel facets creates a tool with a rectangular cutting shape. Alternatively a threading tool that cuts trapezoidal cross-section grooves is fabricated by ion milling two nonparallel facets (as shown in FIGS. 2C and 2D).

After creating side facets 54, 56, the focused ion beam is used to define rake features that clear chips during ultra-precision machining. A focused ion beam system can accurately define the rake angle with a resolution of 0.25°. FIB sputtering is also used during this step to set the rake facet length, typically 10–20 $\mu$m.

A sharp cutting edge 51 having clearance is created at the microtool end as a final step of fabrication. Tools are first rotated to their original orientation with respect to the ion beam, and the length is reduced approximately 3 $\mu$m by sputtering. This creates an end facet that intersects the rake facet at a well-defined, sharp edge. Scanning electron microscopy (SEM) measurements show this edge has a radius of curvature ($R_c$) of 0.4 $\mu$m or less.

Helical Coil Example

1. A polished, cylindrical workpiece 10 is mounted into a pin vice concentric with the axis of rotation of a Precitech Optimum 2000 high precision lathe. The Precitech lathe operates with both the x and z axis drive mechanisms mounted on a granite platform lapped co-planar to 1.3 $\mu$m and isolated from the machine frame to prevent unwanted vibrations. Identical fully-constrained, dovetail-type air bearing slides provide smooth motion for the two axes with less than 0.25 $\mu$m deviation per 102 mm of motion. The total length of travel is 191 mm and the maximum slide speed is 1000 mm/min. The two slides are oriented perpendicular to within 2 arc-seconds. Linear laser holographic scales and read-head assemblies provide stable positional feedback for both axes with 8.6 nm resolution. The spindle is supported by fully pre-loaded, high stiffness air bearings and is driven by an integrally mounted brushless DC motor and encoder with range from 0 to 5000 rpm. In order to accurately 'touch-off', nonconductive workpieces are coated with a 20 nm thick, conductive layer of Au/Pt prior to mounting. Cutting operations, and registry, are also monitored with an optical microscope and CCD camera. Water continuously flushes workpieces during ultra-precision machining. After machining, workpieces are rinsed with isopropyl alcohol.

A tool holder post is arranged perpendicular to the axis of rotation and the workpiece is polished to run true on the lathe, using a diamond bit, which establishes a workpiece surface finish of approximately 1 $\mu$m (rms) or better.

2. A FIB-fabricated microtool (such as shown in FIG. 2C) is loaded and aligned with its axis perpendicular to the workpiece axis. Using a scribe mark on the mandrel for alignment, the tool is then rotated to an orientation such that the tool-end cutting edge is nearly parallel to the workpiece axis. An alignment accuracy of tool cutting edges to better than 0.5° ensures minimal contact of sidewall facets with the groove wall. The microtool is then stepped toward the rotating workpiece and registered. Once the workpiece is contacted, the tool is driven into the workpiece to a targeted groove depth and linear motion is initiated to cut helical groove 20 in a single pass.

Using this technique, micro-grooving tools cut an eight turn, 30 $\mu$m wide, 10 $\mu$m deep helical groove 20 into a one mm diameter cylindrical sample made of Macor®, a machinable ceramic. The pitch between successive passes was 70 $\mu$m and was set by the relative rotation rate and the axial feed rate. A change in pitch can be achieved by simply increasing/decreasing these rates. A 1 mm wide pad 24 is cut into each end of groove 20 to serve as a connection point for an electrical conductor to external circuitry. Electron microscopy demonstrated a close matching of tool size and micromachined feature width. Also, high magnification images demonstrate close matching of tool shape and feature cross-section. SEM analysis of the micromachined groove bottom shows a 6° taper with respect to the cylinder axis, which is identical to the angle of the tool-end cutting edge.

3. A seed layer of copper ~20 nanometers thick is deposited on the cylinder, covering all grooves. The layered cylinder is subsequently copper plated to a level whereby copper in the grooves extends 12 microns above the original surface of the cylinder.

4. The excess copper is removed by polishing, etching, or machining to the original ceramic cylindrical surface in order to isolate the metal in the helical groove. A preferred way is to have the original cylinder a littler larger in diameter than the final product, and to machine the plated cylinder to the final diameter.

Variations

Figure 3:
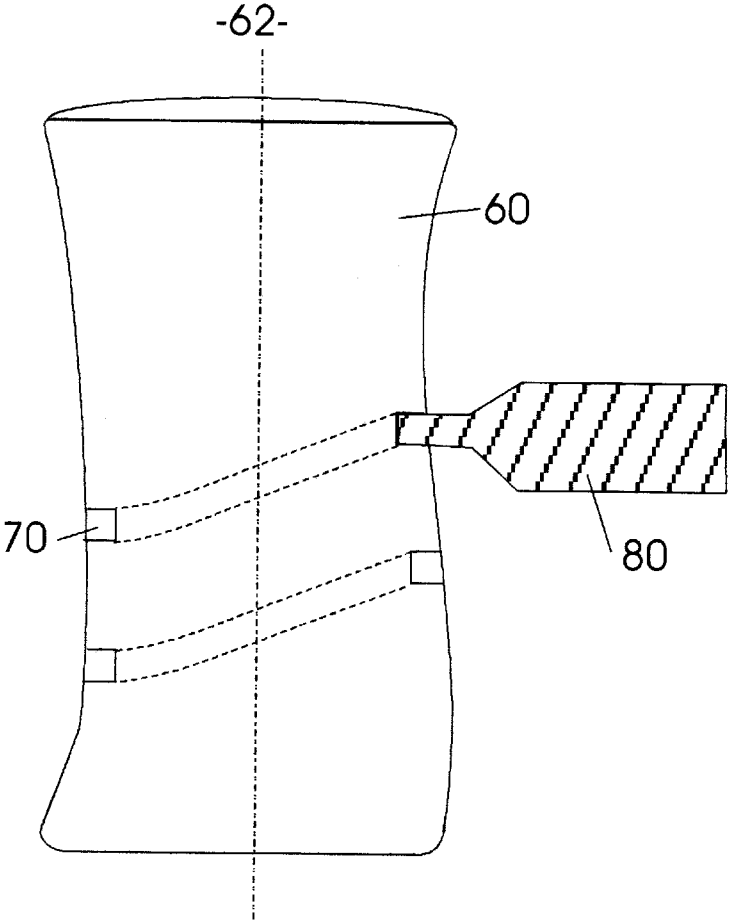
FIG. 3 shows a sectional view of another embodiment of the invention.

It should be understood that the invention is not limited to the example discussed above. For example, while the invention is most easily implemented on a cylinder, it could also be implemented as shown in FIG. 3 on any curved surface 60 that surrounds an axis upon which surface 60 may slowly rotate. Groove 70 could be cut by a tool 80 that includes a contact sensor (not shown) mounted adjacent tool 80 to sense the position of the surface and adjust the position of tool 80 accordingly to cut the desired groove. Preferably, the surface is symmetrical about the axis such that every cross section that cuts the axis is identical to every other such cross-section. Such a surface could be turned on a lathe and easily processed with the equipment discussed above.

Figure 4:
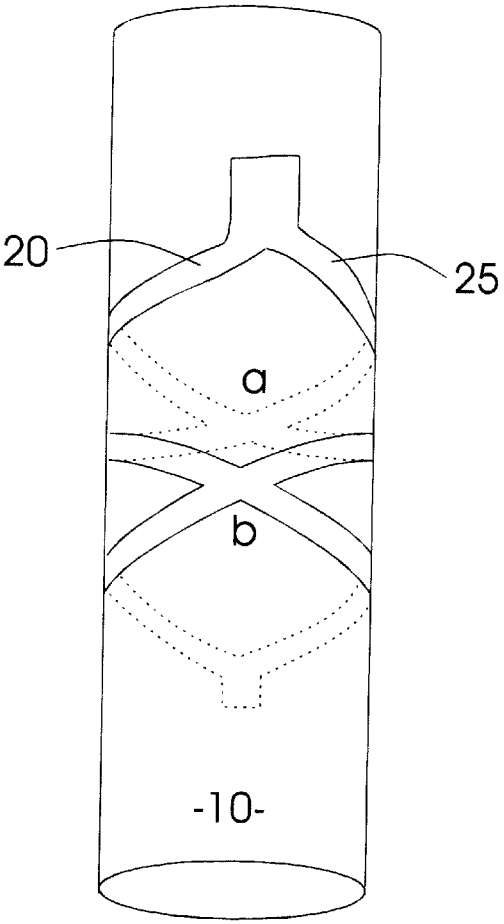
FIG. 4 shows a multi-coil embodiment of the invention.

FIG. 4 shows an embodiment where a multi-element device 28 may be manufactured. As in FIG. 1, a first groove 20 having a pattern such as a multi-turn helical coil is cut into substrate (rod) 10. A second groove 25 forming another multi-turn helical coil is also cut into substrate 10, but groove 25 winds in an opposite direction from groove 20, causing grooves 20 and 25 to intersect at multiple locations a, b along each groove. When a second material is added to substrate 10 to fill the grooves, and subsequently is removed, as discussed above, the resulting structure 28 formed by the second material is two interconnected coils.

Whether a multi-element design as in FIG. 4, or a single coil as in FIG. 1, is formed by this invention, it is further contemplated that the element may be removed from substrate 10 to yield a free-standing element. Such removal may be accomplished by using a substrate material that may be melted or dissolved without effecting the element. Alternatively, if the second material is elastic, it may be mechanically removed from the substrate.

The size characteristics of the coil are also not limited to the example discussed above. The number of turns may extend from one to many, and the spacing between and depth of coils may be constant or varying over the length of the coil. Furthermore, the coils do not have to be helical; they could be a plurality of loops connected by other elements extending from loop to loop.

The choice of materials depends on the application. For an electronic coil, obviously a conductive material will be used with an insulating substrate. If a multi-coil device is to be used as a medical stint, then other materials may be employed. If the primary groove-filling material does not adhere well to the substrate, then the primary material may be considered to be combination of materials, with a first layer or layers being applied to promote adhesion and subsequent layer or layers being applied to fill the groove and cover the substrate. However, it is a characteristic of the invention that the groove-filling material must not extend from one turn of the groove to another turn on the surface of the substrate; such material must be removed in order that the coil is defined by the groove.

It is intended that the scope of the invention be defined by the claims appended hereto.

What is claimed is:

1. A process for fabricating coils comprising:

providing a curved substrate having a surface extending along and symmetrical about an axis, said substrate being made of a first material and having a maximum diameter about said axis on the order of 1 cm;

forming a groove in the curved surface along and around said axis, said groove extending into the surface for a minimum depth and at least one turn around said axis;

filling the groove with a second material different from the first material to form a coil of second material in said first material, wherein the filling step causes excess second material to overflow the groove and cover at least a portion of the surface; and removing all the excess second material from the surface without removing all the material from the groove.

2. The process of claim 1 wherein said removing step further comprises removing a portion of the surface of the substrate, the portion being less than the depth of the groove.

3. The process of claim 1 wherein the first material is an electrical insulator and the second material is an electrical conductor.

4. The process of claim 3 wherein the second material is selected from the group consisting of metals; metal alloys; and superconductors.

5. The process of claim 4 further comprising another layer separating substrate and coil.

6. The process of claim 1 wherein the first material is selected from the group consisting of plastic, ceramic, metal and semiconductor.

7. The process of claim 1 wherein each of the first and second materials are electrical conductors, and further comprising the step of placing an intermediate non-conducting layer between the substrate and coil.

8. The process of claim 1 wherein said step of forming a groove comprises:

rotating said substrate about said axis; and cutting a helical groove with a tool that moves axially relative to said surface while said substrate rotates.

9. The process of claim 8 wherein said step of removing excess second material comprises:

rotating said substrate about said axis; and cutting, polishing or dissolution of said excess material with a tool.

10. The process of claim 9 wherein said step of cutting away said excess material further comprises removing a portion of the surface of the substrate.

11. A process for fabricating coils comprising:

providing a curved substrate having a surface extending along and about an axis, said substrate being made of a first material;

forming a first groove in the curved surface along and around said axis, said first groove extending into the surface for a minimum depth and extending around said axis for a plurality of turns, wherein the first groove is helical;

filling the first groove with a second material different from the first material to form a coil of second material in said first material; and forming a second groove in said substrate, the second groove intersecting the first groove at a plurality of spaced locations along each groove; wherein said filling step fills the second groove and the first groove.

12. The process of claim 11 wherein the filling step causes excess second material to overflow the grooves and cover at least a portion of the surface; and the additional step of removing all the excess second material from the surface without removing all the material from the grooves.

13. The process of claim 12 further comprising separating the formed second material from the substrate.

14. The process of claim 13, wherein said separating step comprises destroying the substrate without damaging the second material.

15. A process for fabricating coils comprising:

providing a curved substrate having a surface extending along and about an axis, said substrate being made of a first material;

forming a groove in the curved surface along and around said axis, said groove extending into the surface for a minimum depth and at least one turn around said axis;

filling the groove with a second material different from the first material to form a coil of second material in said first material; and separating the formed second material from the substrate by destroying the substrate without damaging the second material.

* * * * *